US006176752B1

(12) United States Patent
Tjaden et al.

(10) Patent No.: US 6,176,752 B1
(45) Date of Patent: Jan. 23, 2001

(54) BASEPLATE AND A METHOD FOR MANUFACTURING A BASEPLATE FOR A FIELD EMISSION DISPLAY

(75) Inventors: Kevin Tjaden; David A. Cathey, both of Boise; John K. Lee, Meridian, all of ID (US)

(73) Assignee: Micron Technology, Inc., Boise, ID (US)

( * ) Notice: Under 35 U.S.C. 154(b), the term of this patent shall be extended for 0 days.

(21) Appl. No.: 09/152,772

(22) Filed: Sep. 10, 1998

(51) Int. Cl.[7] ..... H01J 9/00

(52) U.S. Cl. ..... 445/24; 445/50; 438/20; 313/309

(58) Field of Search ..... 445/24, 49, 50, 445/51, 25, 33; 438/20, 34, 22, 23, 28; 257/10, 11; 313/309, 310, 495, 496, 336, 351

(56) References Cited

U.S. PATENT DOCUMENTS

| | | | |
|---|---|---|---|
| 4,940,916 | 7/1990 | Borel et al. | 313/306 |
| 5,162,704 | 11/1992 | Kobori et al. | 315/349 |
| 5,186,670 | 2/1993 | Doan et al. | 445/24 |
| 5,194,344 | 3/1993 | Cathey, Jr. et al. | 430/5 |
| 5,194,346 | 3/1993 | Rolfson et al. | 430/5 |
| 5,205,770 | 4/1993 | Lowrey et al. | 445/24 |
| 5,210,472 | 5/1993 | Casper et al. | 315/349 |
| 5,212,426 | 5/1993 | Kane | 315/169.1 |
| 5,229,331 | 7/1993 | Doan et al. | 437/228 |
| 5,232,549 | 8/1993 | Cathey et al. | 456/633 |
| 5,259,799 | 11/1993 | Doan et al. | 445/24 |
| 5,283,500 | 2/1994 | Kochanski | 315/58 |
| 5,319,233 * | 6/1994 | Kane | 313/309 |
| 5,372,973 | 12/1994 | Doan et al. | 437/228 |
| 5,653,619 | 8/1997 | Cloud et al. | 445/24 |
| 6,074,887 * | 6/2000 | Lee et al. | 438/20 |

OTHER PUBLICATIONS

Lee, Kon Jiun, "Current Limiting of Field Emitter Array Cathodes," thesis, Georgia Institute of Technology, 1986.

Yokoo et al., "Active Control of Emission Current of Field Emitter Array," *Revue "Le Vide, les Couches Minces"*—Supplement au N°271—Mar.–Apr. 1994, pp. 58–61.

* cited by examiner

*Primary Examiner*—Michael H. Day
*Assistant Examiner*—Joseph Williams
(74) *Attorney, Agent, or Firm*—Dorsey & Whitney LLP

(57) ABSTRACT

The present invention is a baseplate that has a supporting substrate with a primary surface upon which an array of emitters is formed. An insulator layer with a plurality of cavities aligned with respective emitters is disposed on the primary surface, and an extraction grid with a plurality of cavity openings aligned with respective emitters is deposited on the insulator layer. The extraction grid is made from a silicon based layer of material. A current control substrate formed from the silicon based layer of material of the extraction grid is provided such that the current control substrate is electrically isolated from the extraction grid and electrically connected to the emitters. The current control substrate has sufficient resistivity to limit the current from the emitters.

8 Claims, 5 Drawing Sheets

BASEPLATE AND A METHOD FOR MANUFACTURING A BASEPLATE FOR A FIELD EMISSION DISPLAY

TECHNICAL FIELD

The present invention relates to cold-cathode field emission displays, and, more particularly, to baseplates for field emission displays that have internal current-limiting devices.

BACKGROUND OF THE INVENTION

Field emission displays (FEDs) are packaged vacuum microelectronic devices that are used in connection with computers, television sets, camcorder viewfinders and other electronic devices requiring flat panel displays. FEDs have a baseplate and a faceplate juxtaposed to one another across a narrow vacuum gap. In large FEDs, a number of spacers are positioned between the baseplate and the faceplate to prevent atmospheric pressure from collapsing the plates together. The baseplate typically has a base substrate upon which an array of sharp, cone-shaped emitters are formed. The emitters in each of the rows or columns of the array may be connected to each other and isolated from the emitters in the other rows or columns, respectively. An insulator layer is positioned on the substrate having apertures through which the emitters extend, and an extraction grid formed on the insulator layer around the apertures. The faceplate has a substantially transparent substrate, a transparent conductive layer disposed on the transparent substrate, and a cathodoluminescent material deposited on the transparent conductive layer.

In operation, a potential is established across the extraction grid and the emitters to extricate electrons from the emitters. The electrons pass through the holes in the insulator layer and the extraction grid, and impinge upon the cathodoluminescent material in the desired pattern. In the event that the emitters in a row or column are interconnected and isolated from the emitters in other rows, the emission of electrons from the emitters in individual rows or columns can be controlled.

FEDs may also have a current control device to switch or limit the amount of current that can flow through the emitters. Limiting the emitter current is important because an excessively high current generates a significant amount of heat in the emitters, which may damage or destroy the emitters. Conventional current-limiting devices may be fabricated on the base substrate or a separate substrate formed within the vacuum chamber of an FED. Switching the emitter current is performed in various emitter addressing schemes with several row lines or column lines coupled to switches formed on the baseplate by implanting various materials into the base substrate. The base substrate in such FEDs is often a complex, expensive component to manufacture, and forming current control devices on the base substrate makes the base substrate even more complex. Accordingly, forming current control devices on the base substrate is often more time-consuming and costly than forming the same devices on a separate substrate. Thus, it is often more desirable to fabricate current control devices on a separate substrate Conventional processes for making an FED having a separate substrate for a current control device typically involve forming the emitters on top of a conductive material, and then masking the emitters with a protective layer. The separate substrate for the current control devices is then deposited on the unprotected areas, after which the mask is removed from the emitters. Subsequently, an insulator layer is disposed over the emitters and the separate substrate, and a layer of conductive material is disposed over the insulator layer. The area over the separate substrate is then masked, and the extraction grid is formed from the conductive layer of material by a chemical mechanical planarization (CMP) process. Conventional baseplates are designed with the understanding that it is desirable to form the grid from a highly conductive material such as a metal or conductive polycrystalline. Finally, the mask over the separate substrate is removed. The separate substrate may be made from a material having sufficient resistivity to act as a resistor, thus allowing the separate substrate itself to act as a current-limiting device. A power source is connected to the separate substrate such that electrons flow to the emitters through the separate substrate.

One problem with forming a separate substrate for the current control device is that it increases the cost of producing an FED. In addition to the basic steps of forming an FED, the production of a separate substrate for a current control device requires several masking steps and the step of depositing the separate substrate itself. Moreover, because the separate substrate for a current control device is often made from a different material than the other components of an FED, it requires separate and generally less efficient handling procedures. Therefore, it would be desirable to develop a process for manufacturing a baseplate with a separate substrate for a current control device that uses fewer steps and fewer materials.

SUMMARY OF THE INVENTION

The baseplate of the present invention has a supporting substrate with a primary surface upon which an array of emitters is formed. An insulator layer with a plurality of openings aligned with respective emitters is disposed on the primary surface, and an extraction grid with a plurality of cavity openings aligned with respective emitters is deposited on the insulator layer. The extraction grid is made from a silicon based layer of material. A substrate that is separate from the supporting substrate is formed from the same silicon based material used for the extraction grid and is electrically isolated from the extraction grid. A current control device on the separate substrate is electrically connected between the emitters and a voltage source such that electrons from the voltage source flow through the current control substrate to the emitters. In one embodiment, the silicon based material of the grid and current control substrate is sufficiently resistant to allow the current control substrate itself to limit the current to the emitters.

The inventive method for manufacturing a baseplate of the present invention includes forming emitters on a supporting substrate, disposing a dielectric material over the emitters and the supporting substrate, and depositing a silicon based material on the dielectric material. The silicon based material is deposited such that it has a first section positioned over at least a portion of the emitters and a second section that is contiguous with the first section. A number of cavity openings are then fabricated in the first section such that each cavity opening is aligned with a corresponding emitter. The layer of silicon based material is then processed to electrically isolate the first and second sections from one another. The dielectric material in the cavity openings of the grid and adjacent to the emitters is removed to open the emitters to the holes. The second section of the silicon based material provides a separate substrate on which a current control device may be formed to control the current flowing to the emitters.

DETAILED DESCRIPTION OF A PREFERRED EMBODIMENT

Figure 1:
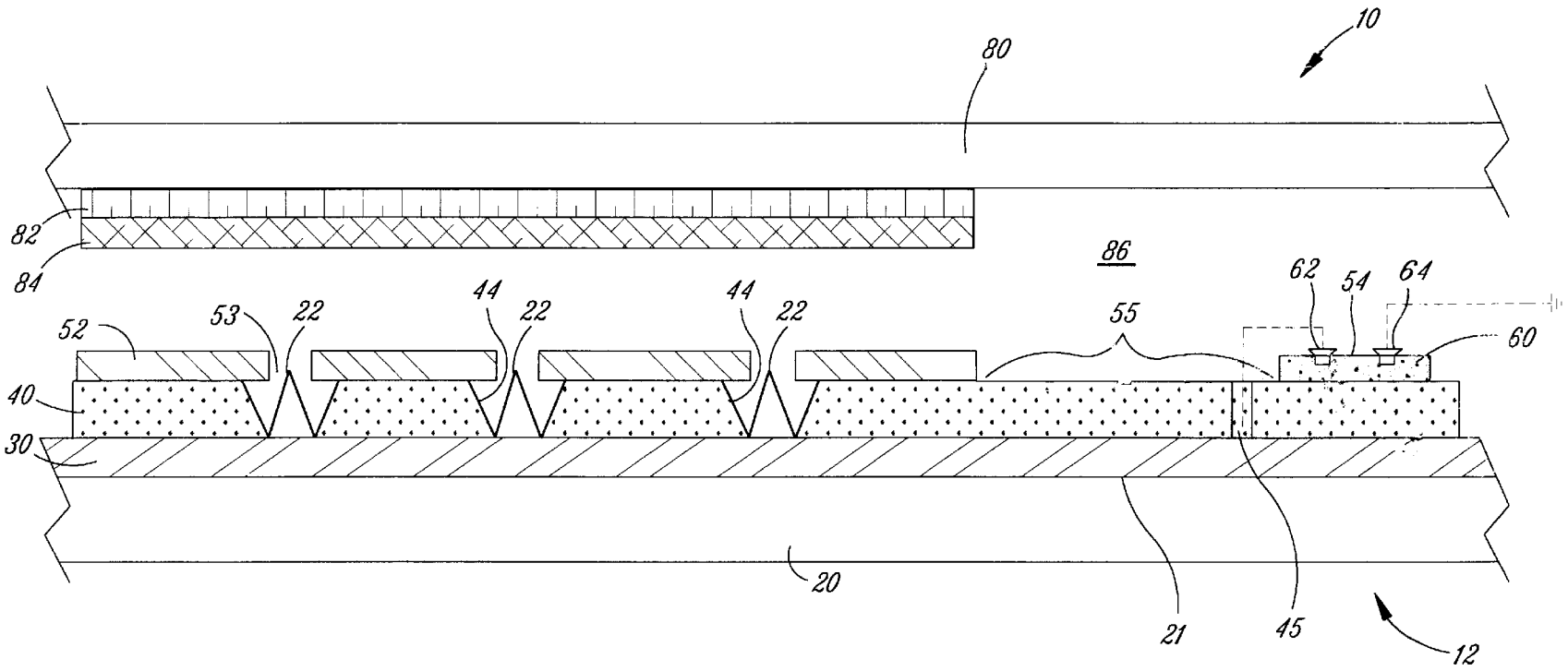
FIG. 1 is a cross-sectional view of a portion of a baseplate having an extraction grid and a passive current control device fabricated from the same layer of material in accordance with the invention.
Figure 2:
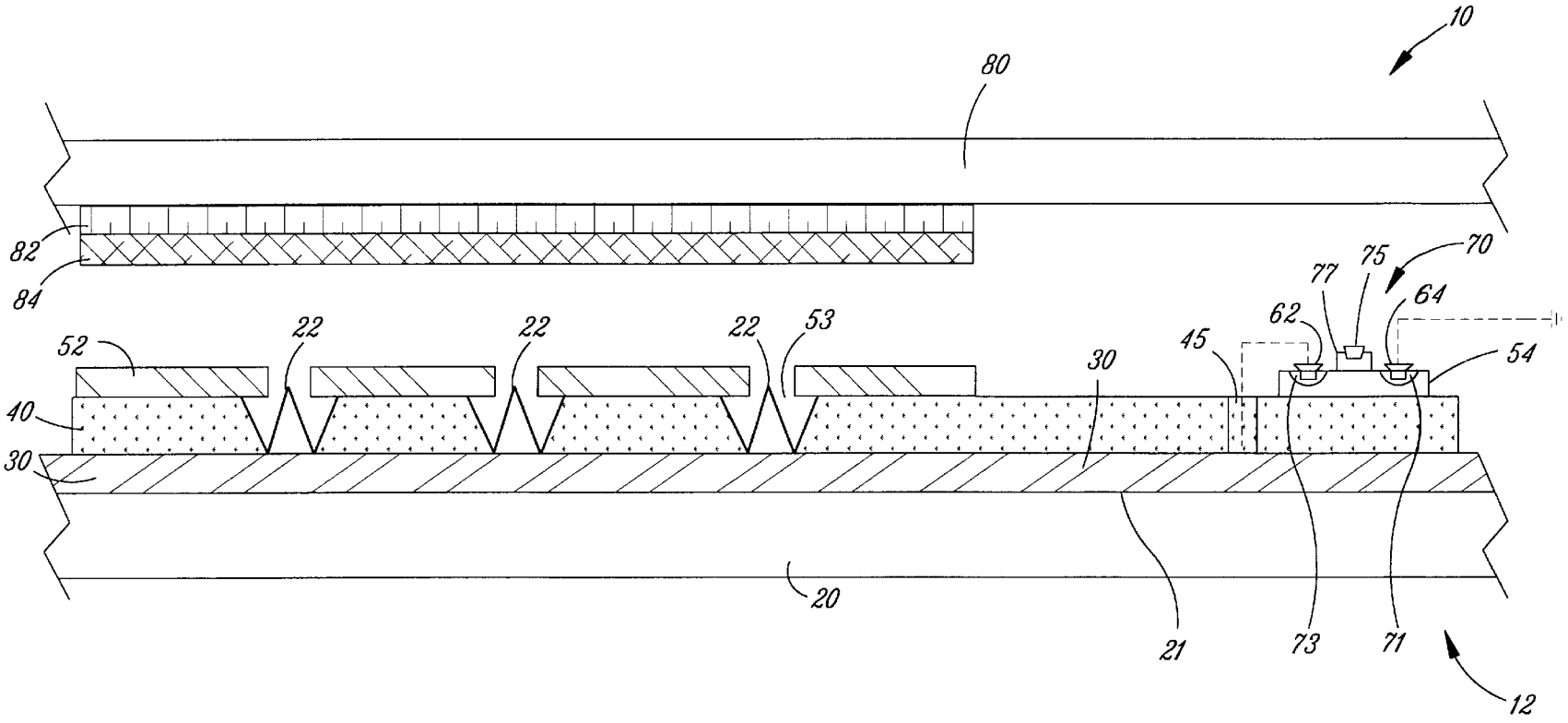
FIG. 2 is a cross-sectional view of a baseplate for use in a field emission display having an extraction grid and an active current control device fabricated from the same layer of material in accordance with the invention.

FIGS. 1 and 2 illustrate FEDs with an extraction grid and a current control substrate that are both fabricated from the same layer of material. FIGS. 3A–3E and FIG. 4 illustrate a process of fabricating a baseplate in which the extraction grid and the current control substrate are formed from the same layer of material. Like reference numbers refer to like component parts throughout the various figures.

The present invention provides a current control substrate that is separate from a supporting substrate that may itself be a current-limiting device. The current control substrate provides a platform upon which virtually any type of current control device may be fabricated to switch or limit the emitter current. One of the central aspects of the invention is that the separate current control substrate is formed from the same layer of material as the extraction grid in a single step. The extraction grid may be made from a generally resistive material in contravention to the conventional understanding of using substantially conductive materials for the extraction grid. Therefore, the current control substrate may be sufficiently resistive to limit the emitter current, thus making a current-limiting device of the present invention relatively simple and generally less expensive to fabricate compared to conventional processes for fabricating separate substrates in FEDs.

FIG. 1 illustrates a preferred embodiment of a field emission display 10 in accordance with the invention in which a baseplate 12 is juxtaposed to a faceplate 80 in a spaced apart relationship across a vacuum gap 86. The baseplate 12 has a supporting substrate 20 with a primary surface 21 upon which a conductive material 30 is deposited. The conductive material 30 may be deposited on the substrate in rows or in columns. A number of emitters 22 are constructed on the conductive material 30. If the supporting substrate 20 is conductive, the conductive material 30 may be omitted and the emitters 22 may be formed directly on the substrate 20. An insulator layer 40 is positioned on the conductive material 30 and the supporting substrate 20, and an extraction grid 52 is formed on top of the insulator layer 40. A number of cavity openings 53 are formed in the extraction grid 52 by a chemical mechanical planarization process such that each cavity opening 53 is aligned with an emitter 22. A number of cavities 44 are then etched into the insulator 40 adjacent to the emitters 22 such that the insulator 40 does not block the emitters 22. The differential voltage between the extraction grid 52 and the emitters 22 causes electrons to be extracted from the emitters 22. The extraction grid 52 is made from a silicon based material, which for the purposes of this invention is defined to include polycrystalline silicon, microcrystalline silicon, amorphous silicon and porous materials. The extraction grid 52 is preferably made from a polysilicon material that is more resistant than conventional metal or crystalline grids while still having sufficient conductivity to allow a small current to flow through the extraction grid 52 without resulting in a significant voltage drop. Moreover, by making the extraction grid 52 from an appropriate semiconductor material, its conductivity may be altered through doping or other applicable techniques.

In the overall operation of the FED 10, the electrons are extracted from the emitters 22 by the potential between the extraction grid 52 and the emitters 22. The electrons are further accelerated across the vacuum gap 86 by a larger anode potential on a transparent conductive layer 82 disposed on the inner surface of the faceplate 80. The electrons impinge upon a cathodoluminescent material 84 that is disposed on the transparent conductive layer 82. The cathodoluminescent material 84 transforms the energy of the electrons into light in a desired pattern on the faceplate 80.

A current-limiting substrate 54 separate from the substrate 20 is formed on another section of the insulator layer 40 such that the substrate 54 is electrically isolated from the extraction grid 52. The substrate 54 may itself be a current-limiting device itself, or it may provide a platform on which a current-limiting device may be fabricated. The substrate 54 is formed from the same layer of silicon based material as the extraction grid 52 and is electrically isolated from the extraction grid 52 by suitable means. For example, gap 55 may be etched in the silicon based material with a silicon etch prior to etching the cavities 44 in the insulator layer 40 with an oxide etch. However, other techniques may be used to electrically isolate the current control substrate 54 from the extraction grid 52. For example, the extraction grid 52 may be doped to form an n-type material and the substrate 54 may be doped to form a p-type material, thus forming a p-n junction between the substrate 54 and the extraction grid 52. Since the extraction grid 52 is not more negative than the substrate 54 during normal operation, the p-n junction remains back-biased, thereby electrically isolating the substrate 54 from the extraction grid 52. Other techniques for electrically isolating the substrate 54 from the extraction grid may also be used.

In one embodiment, the silicon based material from which the grid 52 and substrate 54 is formed has sufficient resistivity to act as a passive current-limiting device 60 without further manipulating the current control substrate 54. In another embodiment of the invention, the current-limiting device 60 is formed in the current control substrate 54 by doping the substrate 54 with an appropriate impurity that alters the resistance of the silicon based material. The substrate 54 may be doped with boron, arsenic, phosphorous or other appropriate conductive elements. As explained further below, an active device, such as a current limiting or switching transistor, may also be formed in the current control substrate 54. Electrical contacts 63 and 64 are placed in the current-limiting device 60 such that contact 62 extends through a hole 45 in the insulator layer 40 to the conductive layer 30, and contact 64 extends to a current source. In another embodiment (not shown), the substrate 54 is formed into the hole 45 in direct connection with the conductive layer 30.

In operation, electrons flow through the current-limiting device 60 and conductive layer 30 to the emitters 22. The electrons flowing from the source to the emitters 22 are regulated by the resistance of the passive current-limiting device 60. Accordingly, by selecting the appropriate materials for the current control substrate 54, or the dopants for the substrate 54, the current-limiting device 60 limits the maximum amount of current flowing to the emitters 22 to prevent the emitters from being damaged by excessive heat or spark erosion. It will be understood that one current-limiting device 60 may be provided for either the entire array of emitters or for individual rows or columns of emitters in the array.

FIG. 2 illustrates another embodiment of the invention in which an active current control device 70 is formed onto the current control substrate 54. For purposes of illustration, the active current control device 70 is a field effect transistor having a p-type polysilicon substrate 54 which is n-doped in two regions to form an n-type source 71 and an n-type drain 73. A polysilicon gate 75 is positioned on top of a thin insulative layer 77 that may be made from any number of insulative materials such as silicon dioxide. In operation, the current flowing from the emitters 22 is controlled by varying the voltage applied to the polysilicon gate 75. The active current control device 70 may also be another type of current control device, such as a p-type field effect transistor or a bi-polar transistor. The current control device 70 may be operated in a current-limiting mode to regulate the current flowing from the emitters 22 or in a switching mode to turn on and off the current flowing from the emitters 22. By providing one active current control device 70 for each row or column of emitters 22, the emission of electrons from each row or column may be individually controlled.

Figure 3A:
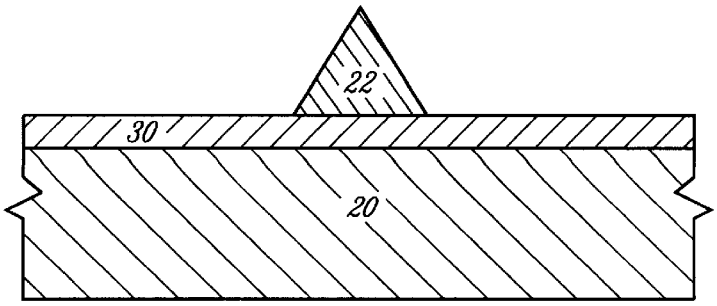
FIG. 3A is a cross-sectional view of a partially fabricated baseplate produced in a step of a method in accordance of the invention.

The process of the invention is illustrated in FIGS. 3A–3E and FIG. 4. The first step 102 of the invention is to form the emitters 22 on the substrate 20, as illustrated in FIG. 3A. The emitters 22 are formed by depositing a layer of semiconductive silicon material on the supporting substrate 20 and conductive layer 30, and depositing an oxide layer on the silicon layer. The oxide is then masked, photo-patterned and etched to define islands of oxide on the surface of the silicon layer. The underlying peripheral regions of the silicon layer beneath the edges of the masked island areas are selectively removed by a plasma-source dry etching process resulting in cone-shaped semiconductor emitters that are positioned in the region immediately under each oxide island. The removal of the underlying peripheral regions of the silicon layer is preferably closely controlled by varying the isotropic and anisotropic characteristics of the etching gas during the etching process. Alternatively, a layer of silicon and a layer of oxide are disposed on the conductive layer 30 and then etched to form islands on the conductive layer 30. The removal of the underlying regions of the silicon layer may be controlled by oxidizing the surface of the silicon around the masked island areas; the duration of the oxidation phase being long enough to produce sideways growth of the resulting oxide layer beneath the peripheral edges of the masked areas so that only a non-oxidized tip of underlying single-crystal substrate beneath the island mask remains on top of the conductive layer 30. The oxidized layer is then differentially etched away in the regions immediately surrounding the masked island areas to result in the production of centrally disposed, cone-shaped semiconductor field emitters at the desired field emission cathode sites.

Figure 3B:
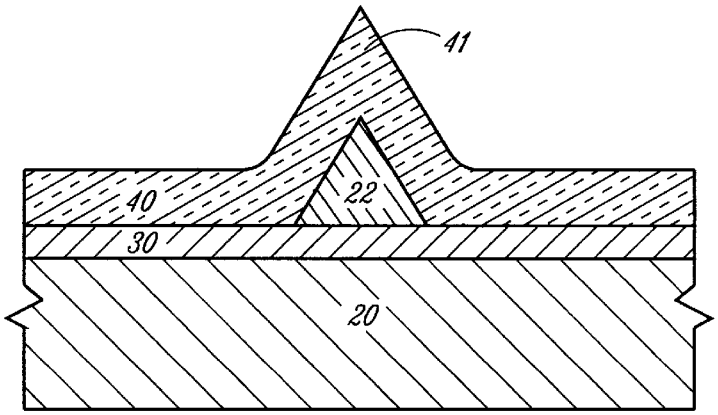
FIG. 3B is a cross-sectional view of another partially fabricated baseplate produced at another step in a method in accordance with the invention.

In the next step 104 of the method, an insulator layer 40 is disposed on the conductive layer 30 and the emitters 22 (only one emitter 22 is shown for clarity), as illustrated in FIG. 3B. In a preferred embodiment, the insulator layer 40 is made from a selectively etchable material such as silicon dioxide, silicon nitride or silicon oxynitride. Other suitable selectively etchable materials may also be used. The thickness of the insulator layer 40 substantially determines the spacing between the extractor grid and both the emitter 22 and the supporting substrate 20. The insulator layer 40 substantially conforms to the shape of the emitter 22 such that it has a raised portion 41 corresponding to the position of the emitter 22.

Figure 3C:
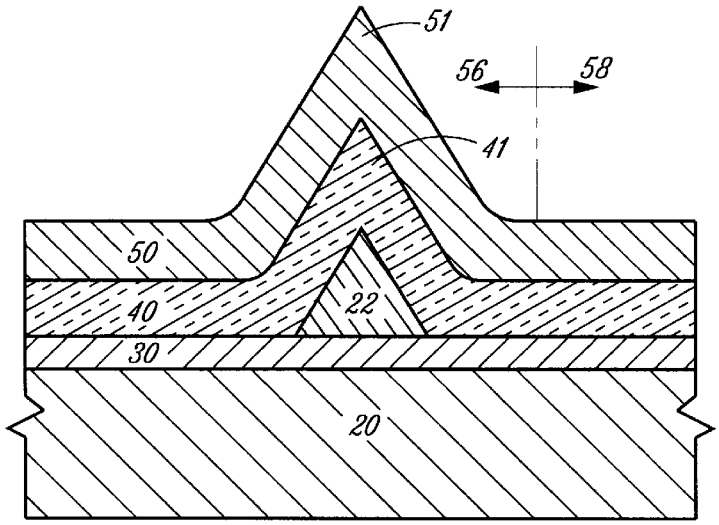
FIG. 3C is a cross-sectional view of another partially fabricated baseplate produced at another step in a method in accordance with the invention.

The next step 106 of the invention is the deposition of a layer of silicon based material 50 on top of the insulator layer 40, as shown in FIG. 3C. The silicon layer 50 also conforms to the shape of the emitters 22 such that it has a bump 51 corresponding to the position of the emitter 22. The silicon layer 50 has a first section 56 and a second section 58 that is contiguous with the first section. The silicon layer 50 is preferably made from a polysilicon material that has the properties to act as the extraction grid 52 and the conductivity substrate 54.

Figure 3D:
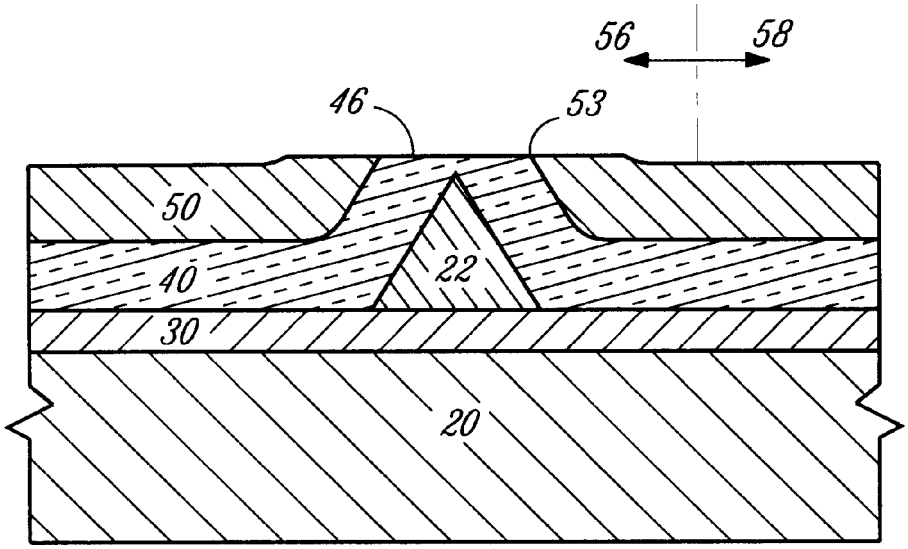
FIG. 3D is a cross-sectional view of another partially fabricated baseplate produced at another step in a method in accordance with the invention.

In another step, a number of holes or cavity openings 53 are fabricated in the first section 56 by a chemical mechanical planarization (CMP) process as disclosed in U.S. Pat. No. 5,186,670, entitled "Method to Form Self-Aligned Gate Structures and Focus Rings," which is incorporated by reference herein. In general, the CMP process involves holding or rotating a wafer of semiconductor material against a wetted polishing surface under a controlled chemical slurry, pressure, and temperature condition. The chemical slurry may contain an abrasive polishing agent, such as alumina or silica, and chemical etchants to simultaneously grind and etch away selected portions of the wafer. Referring to FIG. 3D, the chemical mechanical planarization process produces a substantially planar surface in which a portion 46 of the insulating layer 40 is exposed through the silicon layer 50 just above each emitter 22. Accordingly, the CMP process forms a cavity opening 53 in the first section 56 above each emitter 22.

Figure 3E:
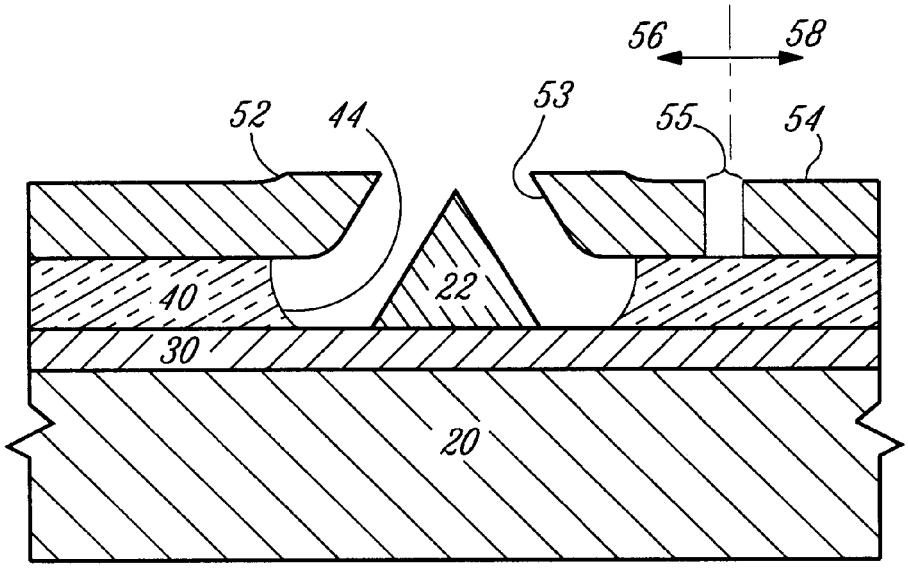
FIG. 3E is a cross-sectional view of another partially fabricated baseplate produced at another step in a method in accordance with the invention.
Figure 4:
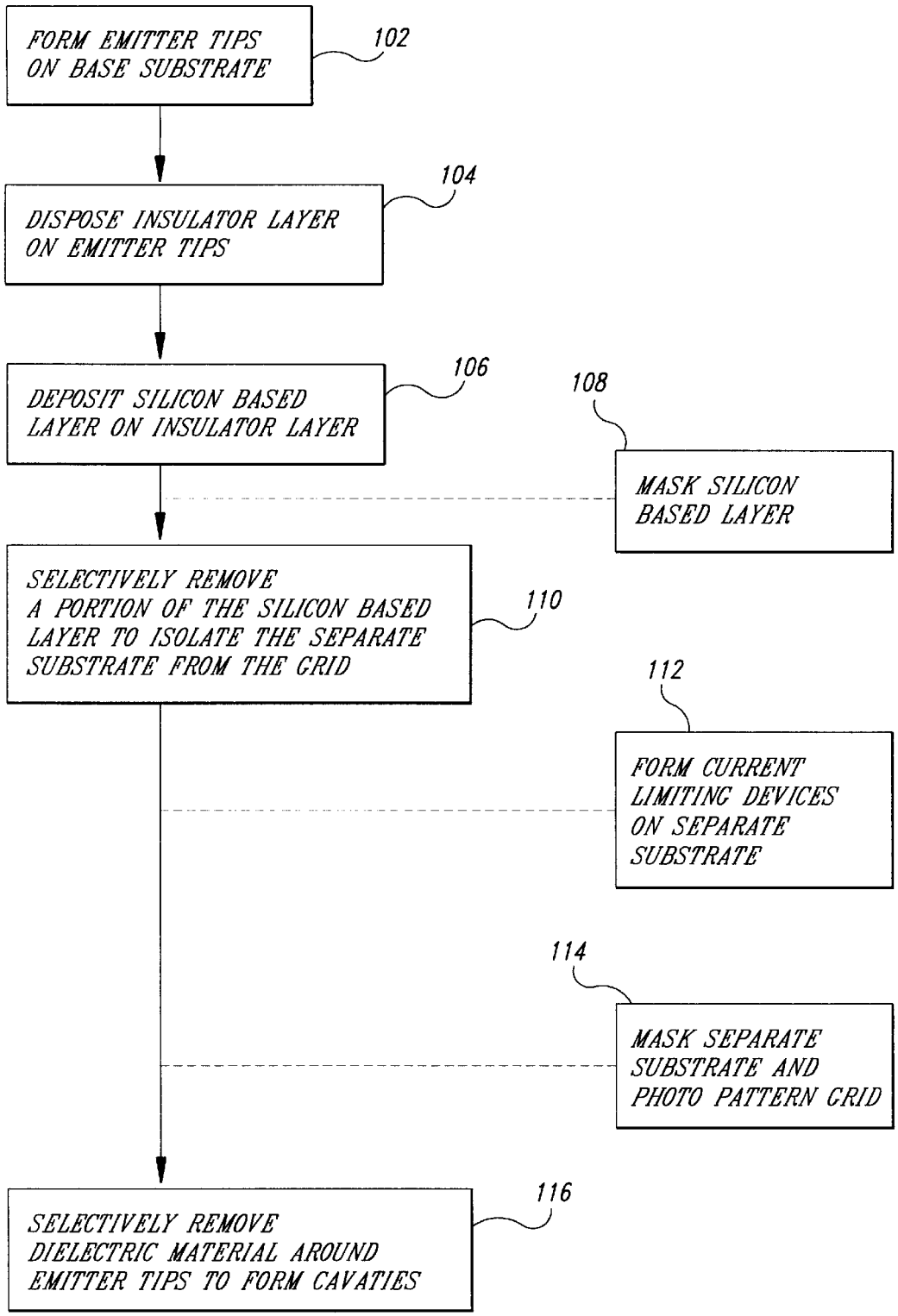
FIG. 4 is a schematic diagram of a method of the invention.

FIG. 3E illustrates the next steps 108–116 of the invention in which cavities 44 are etched in the insulator layer 40, and a gap 55 is etched along a line that separates the first section 56 from the second section 58. A mask of photoresist material (not shown) with a gap between the first and second sections 56 and 58 is photo-patterned on the silicon layer 50 (shown in FIG. 3D), and the gap 55 is etched in the silicon layer 50 between the first and second sections 56 and 58 to form the current control substrate 54. The gap 55 may also be formed by other means such as by masking the area occupied by the gap 55 when the silicon based material is deposited on the insulative layer 40. Furthermore, the silicon layer 50 may be processed by other means, such as appropriate doping, to electrically isolate the current control substrate 54 from the extraction grid 52. In a preferred embodiment, a specific type of current control device may then be formed on the current control substrate 54, or if the substrate 54 has sufficient resistivity, it may serve as the current-limiting current control device itself. A cavity 44 is then selectively etched in the insulator layer 40 to form the grid 52.

The primary advantage of the present invention is that it simplifies the process for producing an FED with a separate current control substrate. By forming the current control substrate and the extraction grid from the same layer of material, the process of the invention requires fewer steps and the device of the invention requires fewer types of material. Unlike conventional processes, the method of the invention does not require depositing a layer of material with sufficient resistivity solely for use as a resistor, or masking the base substrate and resistor several times to protect them at various stages of the process. Additionally, the product of the invention uses the same material for the extraction grid and the current control substrate. Accordingly, it is expected that the invention will reduce the unit cost of producing baseplates.

It will also be evident that, although specific embodiments of the invention have been described herein for purposes of illustration, various modifications may be made without deviating from the spirit and scope of the invention. Accordingly, the scope of the invention is limited only by the appended claims.

What is claimed is:

1. A process for manufacturing a baseplate for use in a field emission display, comprising the steps of:

forming emitters on a supporting substrate;

disposing a dielectric material over the emitters and supporting substrate;

depositing a silicon based layer of material over the dielectric material, the silicon based layer having a first section positioned over at least a portion of the emitters and a second section contiguous with the first section;

fabricating a cavity opening in the first section above each emitter;

electrically isolating the first section from the second section; and selectively removing the dielectric material in the cavity openings and adjacent to the emitters to form cavities that open the emitters to the cavity openings.

2. The process of claim 1, further comprising fabricating a passive current-limiting device on the second section of the silicon based layer.

3. The process of claim 2 wherein the step of fabricating a passive current-limiting device comprises doping a conductance altering agent onto the second section of the silicon based layer.

4. The process of claim 1, further comprising fabricating an active current control device on the second section of the silicon based layer.

5. The process of claim 4 wherein the step of fabricating a current control device comprises fabricating a field effect transistor on the second section of the silicon based layer.

6. The process of claim 4 wherein the step of fabricating a current control device comprises fabricating a bipolar transistor on the second section of the silicon based layer.

7. The process of claim 1 wherein the step of electrically isolating the first section from the second section comprises fabricating the silicon based layer with the first section physically separate from the second section.

8. The process of claim 7 wherein the step of fabricating the silicon based layer with the first section physically separate from the second section comprises fabricating the silicon based layer with the first section contiguous with the second section and then removing a portion of the silicon based layer to physically separate the first section from the second section.

* * * * *